United States Patent [19]

Van Vucht et al.

[11] 3,945,949

[45] Mar. 23, 1976

[54] ALKALI METAL VAPOUR GENERATOR

[75] Inventors: Johannes Hendrikus Nicolaas Van Vucht; Jan Josephus Bernardus Fransen, both of Eindhoven, Netherlands

[73] Assignee: U. S. Philips Corporation, New York, N.Y.

[22] Filed: June 7, 1973

[21] Appl. No.: 367,946

[30] Foreign Application Priority Data

June 15, 1972 Netherlands ..... 7208146

[52] U.S. Cl. ..... 252/514; 252/512; 313/179; 316/3

[51] Int. Cl.[2] ..... H01B 1/02; H01J 9/395

[58] Field of Search ..... 252/512, 514, 181.7; 313/179; 316/3

[56] References Cited

UNITED STATES PATENTS

| | | | |
|---|---|---|---|
| 2,439,647 | 4/1948 | Bramley | 252/514 |
| 2,834,905 | 5/1958 | Lee | 313/179 |

*Primary Examiner*—T. H. Tubbesing
*Assistant Examiner*—Richard E. Berger
*Attorney, Agent, or Firm*—Frank R. Trifari; Leon Nigohosian

[57] ABSTRACT

For the introduction of an alkali metal vapour into an electric discharge tube, in particular for the vapour deposition of surfaces for photo-emission or secondary electron emission in such a tube, generators are used which comprise a filling which consists of at least one alkali metal alloyed with gold and/or silver, and/or copper alloyed with gold or silver.

4 Claims, 2 Drawing Figures

ALKALI METAL VAPOUR GENERATOR

Figure 1:
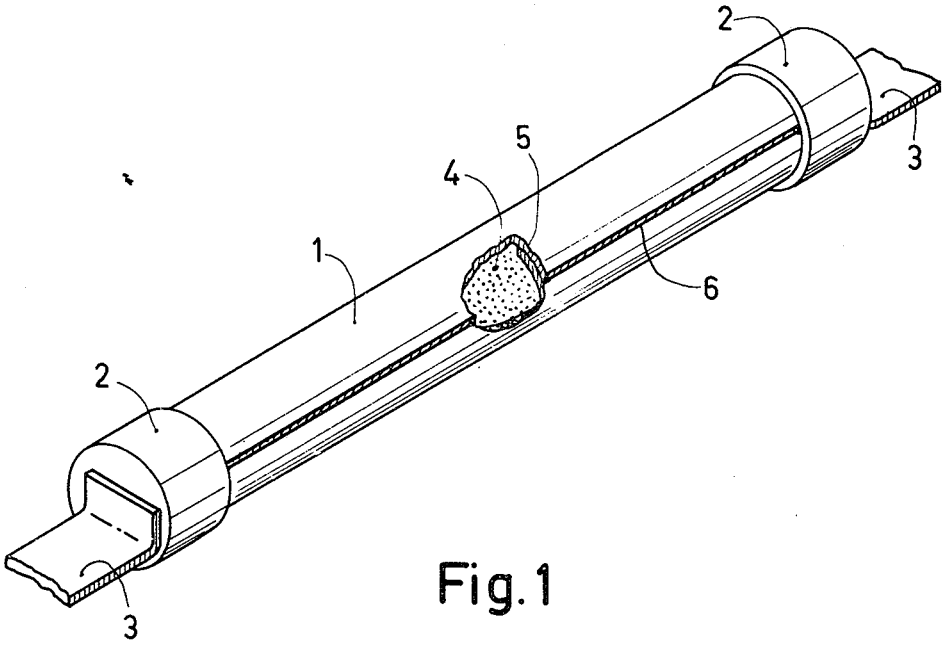

The invention relates to an alkali metal vapour generator comprising a material which mainly consists of one or more alkali metals and a metal having a lower vapour pressure than that of the alkali metal.

The invention furthermore relates to an electric discharge tube comprising at least one surface for photo-emission or secondary electron emission obtained by means of such a generator.

The use of alkali metal vapour generators as mentioned above has so far been mainly restricted to the maintenance of a particularly low residual gas pressure in an evacuated space. In British Patent Specification 151611, for example, a process is described in which an alloy of an alkali or alkaline earth metal and a more noble metal having a smaller vapour pressure is used for the introduction of an alkali or alkaline earth metal vapour in an electric discharge tube. The alkali or alkaline earth metal evaporated in the tube has for its object to getter, after evacuation of the tube, any residual gases present therein.

The usefulness of an alloy from which an alkali or alkaline earth metal can be evaporated by heating depends to a great extent upon the measure in which said metal is released from the alloy in a reproducible manner. The requirements which for that purpose are imposed upon said alloys are that prior to, during or after the evaporation of the alkali metal no or substantially no water vapour, contaminating gases or particles of solid are released therefrom.

In this respect, the requirements in the manufacture of surfaces for photo-emission or secondary electron emission are particularly high. Such surfaces are used in camera tubes in television, photomultiplier tubes, image intensifier tubes and other types of vacuum tubes. Said surfaces usually consist of one or more layers of the alkali metals sodium, potassium and caesium vapour deposited on a substratum of antimony or bismuth. The known generators to obtain an alkali metal vapour usually consist of a metal holder which contains a mixture of a chromate or bichromate of the relevant alkali metal and a reducing agent for said chromate or bichromate. Such generators are described, for example, in the U.S. Pat. No. 3,667,513.

A drawback of chromate-metal mixture is that they are difficult to maintain reproducible when stored in air. Another drawback is that when the alkali metal vapour is released, water vapour and contaminating gases are also released. Said gases can react with the alkali metal and have an adverse influence on the emission properties of the vapour-deposited surfaces. The high temperature of approximately 900°C which is necessary to release a sufficient quantity of alkali metal vapour per unit of time from such a generator moreover contributes to said release of gas being considerable. Still another drawback is that, when the exothermally occurring reactions between the components of the said chromate-metal mixtures have started, the temperature and the reaction rate occurring are difficult to control.

It will be obvious that the said drawbacks constitute an impedance for the provision in a reproducible manner of surfaces for photo-emission or secondary electron emission. A result of this is that the reject percentage of tubes having surfaces thus obtained may be undesirably high.

It is an object of the invention to provide an alkali metal vapour generator of the type described in the preamble which does not show the said drawbacks and which is particularly suitable for use during the manufacture of surfaces for photo-emission or secondary electron emission.

According to the invention, in an alkali metal vapour generator which contains a material which mainly consists of one or more alkali metals and a metal having a lower vapour pressure than that of the alkali metals, the material contains mainly gold and/or silver and/or copper alloyed with gold or silver as a metal having a lower vapour pressure.

It is to be noted that in the above-mentioned British Patent Specification 151,611 an explanation is given for the expression "more noble metal", in relation to the electropositivity of the metals. Exclusively with reference to said relation, gold and platinum are mentioned as examples of those metals which have the lowest electropositivity. It is not suggested at all with the given explanation that alloys of an alkali metal and gold or platinum would be suitable for the introduction of an alkali metal vapour into an electric discharge tube. This is proved once again by the fact that as an example of such an alloy is mentioned only a tin-calcium alloy.

The filling material of the metal vapour generator according to the invention is preferably single-phase or substantially single-phase. This means that the material consists preferably of one single or substantially one single compound of an alkali metal and a metal having a lower vapour pressure as mentioned above, while said compound is moreover present in the filling material in a monocrystalline structure. As a result of this, corrosion as it occurs during the formation of local elements is avoided.

The filling material of the generator according to the invention has important advantages over the known fillings which contain a chromate or bichromate. The gas release of the generator according to the invention is particularly low also due to the fact that sufficient alkali metal vapour is released from the generator at a comparatively low temperature which is approximately 600°C dependent upon the composition of the filling material of the generator. The advantage of this is that the generator according to the invention can be brought to and maintained at the desired operating temperature with an accordingly low power. By controlling the power supplied to the generator, the evaporation process of the alkali metal can be controlled in a simpler and more accurate manner than when using an alkali metal chromate or bichromate due to the lack of an exothermal reaction.

The filling material of the metal vapour generator according to the invention is resistant to attack by moist air to such an extent that it can be introduced into the production process without taking special measures.

A few non-restricting examples of alloys which are preferably used in the generator according to the invention are $Au_2Na$, $Au_5Na$, $Au_2K$, $Au_5K$ and caesium alloys which are rich in gold.

The said alloys are excellently suitable for use in the manufacture of surfaces for photo-emission or secondary electron emission, as they are used in camera tubes for television, photo-multiplier tubes, image intensifier tubes and other types of vacuum tubes.

It is possible in such alloys to fully or partly replace the gold by silver or an alloy of copper and gold or silver. However, the extent of resistance of the alloy to attack by moist air decreases according as the content of gold therein is lower or according as therein more gold is replaced by silver or the said copper alloy.

Various methods are known for the vapour deposition of surfaces for photo-emission or secondary electron emission. One of these methods consists in that the alkali metal vapour generator remains mounted in the tube also after the alkali metal has been evaporated therefrom. According to another method, the alkali metal vapour generator is mounted in an appendix of the tube and after use of the generator the appendix is sealed off from the tube. According to still another method, the electrodes for photo-emission or secondary electron emission are vapour-deposited in a separate vacuum space and then mounted in an electric discharge tube. For the generator according to the invention it is irrelevant which method is used in manufacturing the said electrodes.

It is also possible to simultaneously evaporate sodium and potassium from one alkali metal source. For that purpose, the alkali metal vapour generator according to the invention comprises a mixture of the potassium and sodium alloys suitable according to the invention. The simultaneous vapour deposition of sodium and potassium is also possible if the generator according to the invention comprises a tarnary or multicomponent alloy of sodium, potassium and gold and/or silver and/or copper alloyed with gold or silver.

Figure 2:
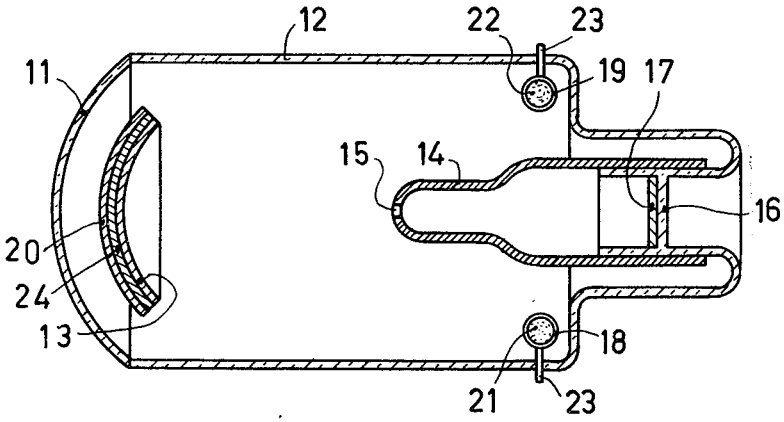

The invention will be described in greater detail with reference to the drawing, in which FIG. 1 is a perspective view partly broken away of an embodiment of an alkali metal vapour generator according to the invention, and FIG. 2 shows an image intensifier tube in which at least one alkali metal vapour generator according to the invention is mounted.

The alkali metal vapour generator shown in FIG. 1 is a sodium vapour generator. The generator is manufactured from a chromium-nickel-steel strip of 80 $\mu$m thickness. In the first instance said strip is bent about its longitudinal axis in such manner that a channel having an approximately U-shaped cross-section is obtained. Said channel is then filled with $Au_2Na$ in powder form, after which the upright walls of the channel are moved towards each other by means of a drawing-rolling operation in such manner that they overlap each other partly as is denoted at 5. During this operation the $Au_2Na$ present as a fine powder is compressed in such manner that prior to, during and after the evaporation of the sodium no particles of solid are released from the generator. Tubes having a length of 21 mm are obtained from the resulting cylindrical tube which has a diameter of 1 mm by means of a severing operation such as cutting or chopping. In the Figure a tube 1 thus obtained is closed at either end by means of a welded chromium-nickel-steel cap 2. A metal strip 3 is welded to each cap 2 through which the electric power is supplied to the generator. An electric current of approximately 4 Amp. is sufficient to bring the $Au_2Na$ powder 4 present in the generator at a temperature of approximately 600°C. At this temperature the sodium evaporates from the alloy to a sufficient extent and then leaves the generator via the chink 6 formed at the overlapping 5 throughout the length of the tube 1.

FIG. 2 is a diagrammatic axial sectional view of an image intensifier tube. The tube comprises a light-pervious window 11 which forms part of a glass envelope 12 of the tube. In the tube, a trialkali photo-cathode 13 is vapour-deposited which emits electrons when photons impinge upon it. The electrons released from the photocathode are accelerated by means of an anode 14 and can reach a second window 16 via an aperture 15 provided therein. On the inside of the window 16 is a luminescent layer 17 which emits photons when electrons impinge upon it. In this manner an image of an article intensified as regards luminance can be observed via the window 16. Electric leadthroughs and connection pins via which the electrodes are set up at a correct potential are not shown so as to avoid complexity of the drawing.

The photocathode is constructed from sodium, potassium and caesium. These metals are vapour-deposited on the inside of a curved, light-pervious support 20 which, in order to reduce the transverse resistance, comprises a conductive layer 24 of tin oxide. Three alkali metal vapour generators according to the invention are mounted on a few lead-through pins 23. A sodium vapour generator 18 filled with $Au_5Na$ power 21 and a potassium vapour generator 19 filled with $Au_5K$ powder 22 are shown in cross-section in the Figure. A third generator not shown in the Figure and filled with a caesium alloy which is rich in gold as well as the generators 18 and 19, are arranged in the tube approximately circularly symmetrically with the cylindrical anode 14. The plate where the generators are mounted in the tube is chosen to be so that the generator cannot exert any disturbing influence on the electron optical reproduction in the tube.

The vapour deposition of the photocathode 13 is carried out after having degassed the tube at a temperature of approximately 450°C for some time. During said degassing no noteworthy quantities of alkali metal vapour emerge from the generators.

By alternately bringing the generators at their operating temperature via the electric lead-throughs 23 by means of an electric current of approximately 4 Amp. the various alkali metals are provided on their substratum. Generally known measures are taken to ensure that the alkali metal vapours released from the generators deposit only on the support 20 destined for this purpose.

What is claimed is:

1. An alkali metal vapour generator comprising a material which consists essentially of at least one alkali metal and a further metal having a lower vapour pressure than said alkali metal, said further metal consisting essentially of at least one element selected from the group consisting of gold, silver and copper, with the proviso that said further metal include at least one of gold and silver.

2. An alkali metal vapour generator as in claim 1, wherein said material is single-phase.

3. An alkali metal vapour generator as in claim 1, wherein said material consists essentially of at least one of the alloys $Au_2Na$, $Au_5Na$, $Au_2K$, $Au_5K$ and a caesium alloy which is rich in gold.

4. An alkali metal vapour generator as in claim 1, wherein said material is a multicomponent alloy consisting essentially of at least one of sodium and potassium, and said further metal.

* * * * *